US006189557B1

(12) United States Patent
Chern

(10) Patent No.: US 6,189,557 B1
(45) Date of Patent: Feb. 20, 2001

(54) FUEL GAS SUPPLY FOR A GAS BURNER

(76) Inventor: Hong-Line Chern, No. 21, Lane 457, Lung-Chiang Rd., Taipei (TW)

( * ) Notice: Under 35 U.S.C. 154(b), the term of this patent shall be extended for 0 days.

(21) Appl. No.: 09/404,581

(22) Filed: Sep. 24, 1999

(51) Int. Cl.[7] ..... F04F 1/00

(52) U.S. Cl. ..... 137/212; 431/344; 222/113; 222/159

(58) Field of Search ..... 431/344; 137/209, 137/212; 222/113, 159

(56) References Cited

U.S. PATENT DOCUMENTS

| | | | | |
|---|---|---|---|---|
| 1,441,171 | * | 1/1923 | Rice | 137/209 |
| 2,335,595 | * | 11/1943 | Kromer et al. | 137/212 |
| 2,838,292 | * | 6/1958 | Bramming | 137/209 |
| 3,140,740 | * | 7/1964 | Lagreid et al. | 431/344 |
| 3,520,323 | * | 7/1970 | Lamb | 137/212 |
| 5,611,366 | * | 3/1997 | Creffield et al. | 137/209 |

FOREIGN PATENT DOCUMENTS

| | | | | |
|---|---|---|---|---|
| 797288 | * | 7/1958 | (GB) | 431/344 |

* cited by examiner

*Primary Examiner*—Ira S. Lazarus
*Assistant Examiner*—Sara Clarke
(74) *Attorney, Agent, or Firm*—Rosenberg, Klein & Lee

(57) ABSTRACT

A fuel gas supply for providing fuel gas to a gas burner, including a fuel gas cylinder having a top guard, a connector assembly installed in the fuel gas cylinder and surrounded by the top guard, the connector assembly having a gas inlet for guiding air into the fuel gas cylinder to mix with fuel oil in producing fuel gas, a gas outlet connected to the gas burner for guiding fuel gas out of the fuel gas cylinder to the gas burner, a first control valve for closing/opening the gas inlet, and a second control valve for closing/opening the gas outlet, and a pump mounted on the top guard and connected to the gas inlet through a transparent tube and controlled to pump air into the fuel gas cylinder, a plurality of check valves installed in the transparent tube to prevent reverse flow of fuel gas.

3 Claims, 6 Drawing Sheets

FUEL GAS SUPPLY FOR A GAS BURNER

BACKGROUND OF THE INVENTION

The present invention relates to a fuel gas supply for use with a gas burner, and more particularly to such a fuel gas supply, which comprises a connector assembly installed in a fuel gas cylinder, the connector assembly having a gas inlet controlled by a gas inlet control valve for input of air and a gas outlet controlled by a gas outlet control valve for output of fuel gas to a gas burner, and a pump mounted on a guard at the fuel gas cylinder and controlled to pump air into the air inlet at the connector assembly for mixing the fuel gas in the fuel gas cylinder.

FIG. 1 shows a fuel gas supply for a gas burner, which is comprised of a fuel gas cylinder 10, and a pump 11. The fuel gas cylinder 10 comprises an inlet pipe 103 on the inside, a gas outlet 105 and a fuel oil filling hole 107 on the outside. The gas outlet 105 is connected to the gas burner (not shown) through a gas outlet tube 12. The pump 11 is mounted on a guard 13 at the top of the fuel gas cylinder 10, and connected to the inlet pipe 103 by a guide tube 115. When the fuel oil filling hole 107 is opened, fuel oil can then be filled into the fuel gas cylinder 10. When the pump 11 is started, air is pumped through the inlet pipe 103 into the inside of the fuel gas cylinder 10 to mix with fuel oil, and to produce fuel gas for output to the gas burner through the gas outlet 105 and the gas outlet tube 12. Because the fuel gas cylinder 10 is specially designed, regular commercially available fuel gas cylinders cannot be used as a substitute.

SUMMARY OF THE INVENTION

The present invention has been accomplished under the circumstances in view. According to one aspect of the present invention, the fuel gas supply is comprised of a fuel gas cylinder, which can be easily obtained from the market, a connector assembly installed in the fuel gas cylinder for output of fuel gas and input of air, and a pump mounted on the top guard at the fuel gas cylinder and controlled to pump air into the connector assembly and the fuel gas cylinder to mix with fuel oil in the fuel gas cylinder, causing a fuel gas to be produced. According to another aspect of the present invention, a transparent tube is connected between the connector assembly and the pump for guiding air from the pump to the connector assembly and the fuel gas cylinder. Wherein the transparent tube comprises a plurality of check valves that prevent reverse flow of fuel gas from the fuel gas cylinder to the pump. According to still another aspect of the present invention, the connector assembly comprises a gas inlet connected to the pump, a gas outlet connected to the gas burner, a gas inlet control valve rotated to close/open the gas inlet, and a gas outlet control valve rotated to close/open the gas outlet.

DETAILED DESCRIPTION OF THE PREFERRED EMBODIMENT

Figure 1:
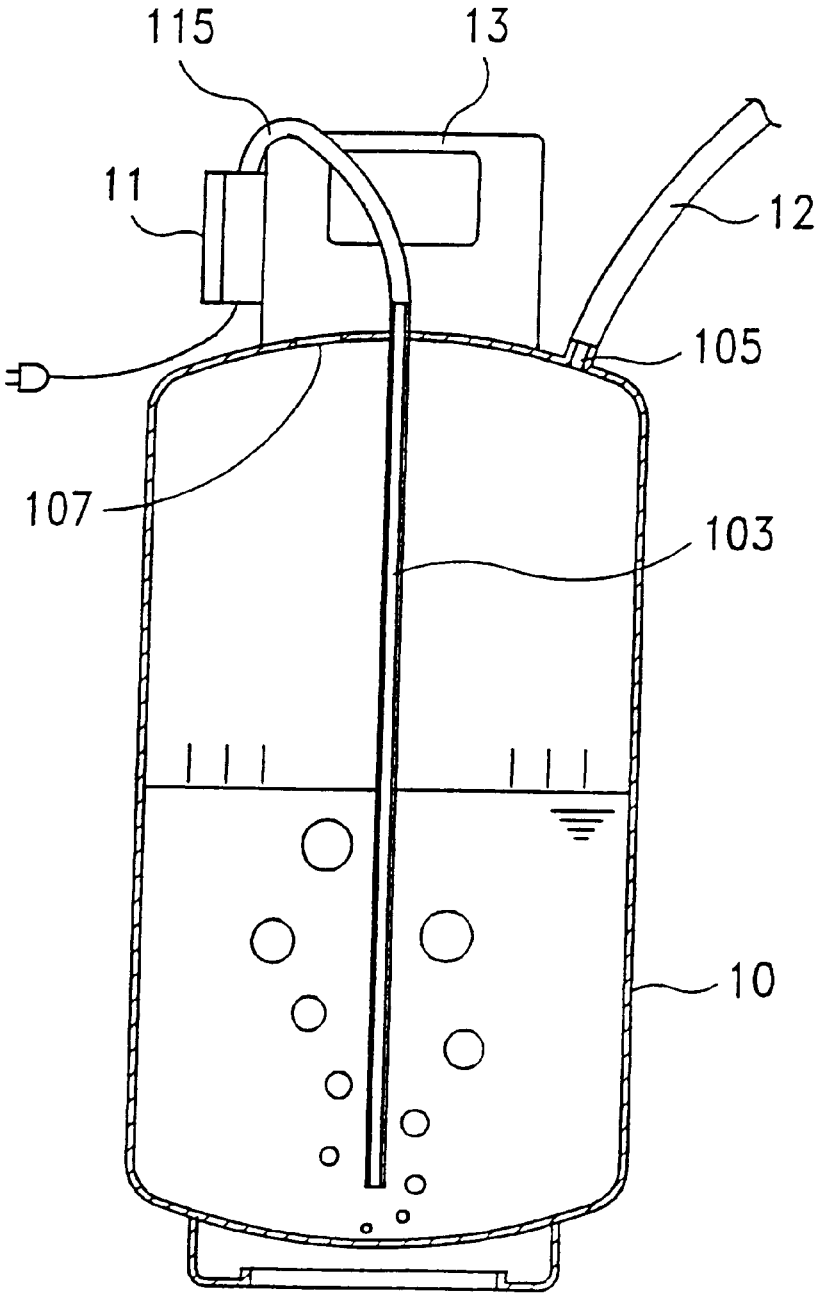
FIG. 1 Prior Art
FIG. 1 illustrates a fuel gas supply for a gas burner according to the prior art.
Figure 2:
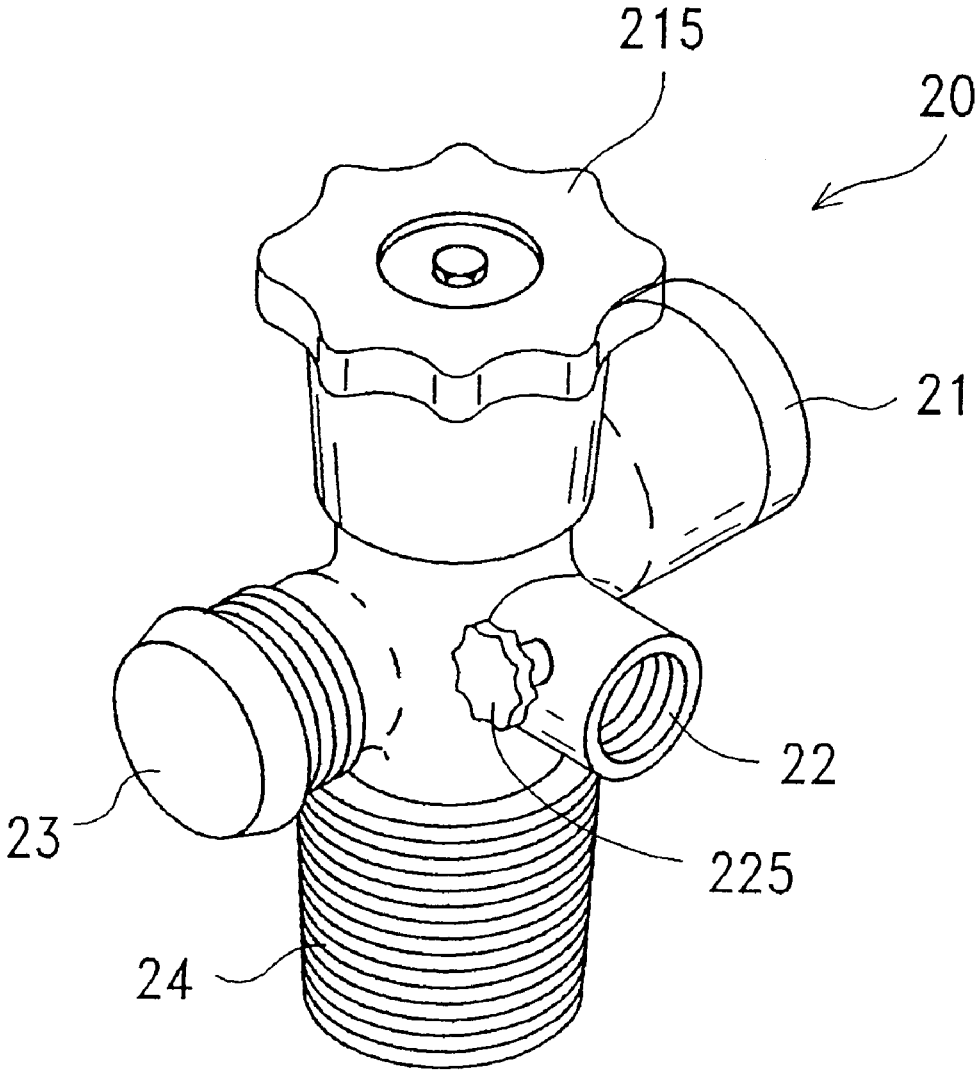
FIG. 2 is a perspective view of a connector assembly for a fuel gas supply according to the present invention.
Figure 3:
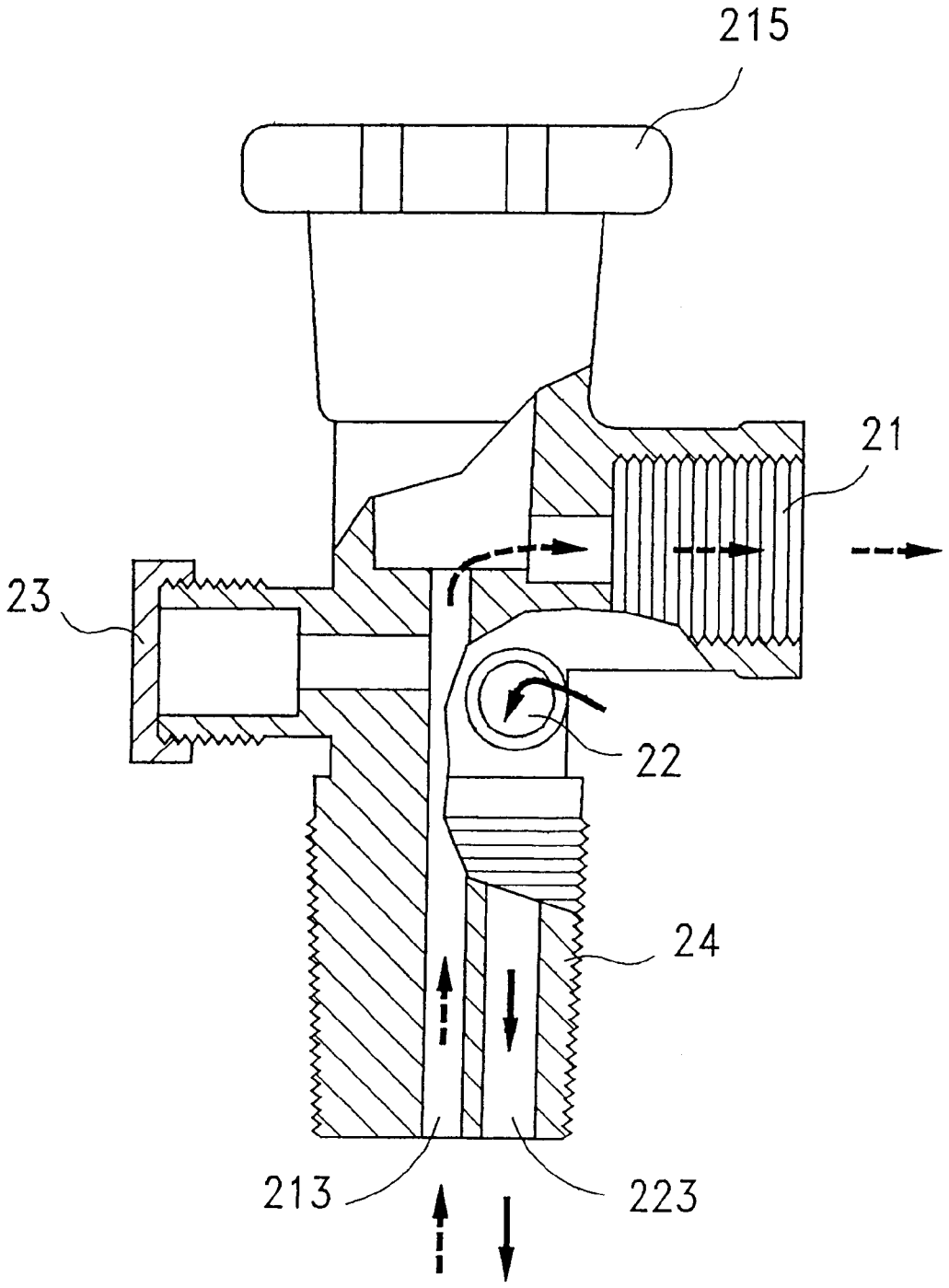
FIG. 3 is a sectional view of the connector assembly showing the gas input path and the gas output path according to the present invention.

Referring to FIGS. 2 and 3, a connector assembly 20 is shown comprising a vertical gas output passage hole 213 extended to the bottom side thereof. A transverse gas outlet 21 extends from the top end of the vertical gas output passage hole 213 for output of fuel gas. A rotary fuel gas output control valve 215 is provided at the top side thereof and rotated to close/open the passage between the vertical gas output passage hole 213 and the transverse gas outlet 21. The connector assembly 20 also comprise, a transverse gas inlet 22 and, a vertical gas input passage hole 223 that is vertically downwardly extended from the transverse gas inlet 22 to the bottom side and disposed in parallel to the vertical gas output passage hole 213. A rotary gas input control valve 225 is provided at the transverse gas inlet 22 and rotated to close/open the passage between the transverse gas inlet 22 and the vertical gas input passage hole 223. An outer thread 24 is formed around the periphery of the bottom end of the connector assembly for fastening to a gas cylinder, and a safety valve 23 at one side thereof.

Figure 4:
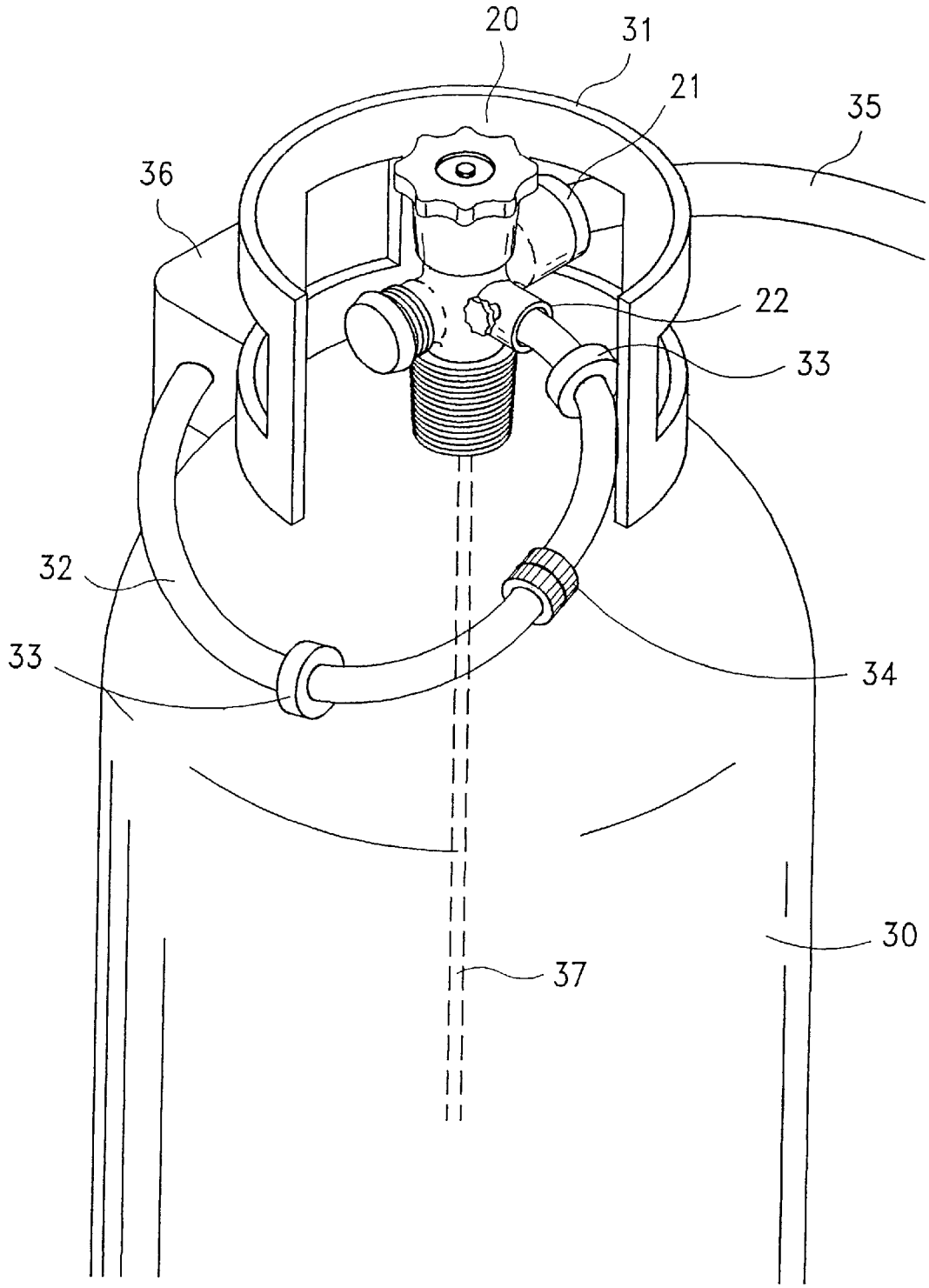
FIG. 4 illustrates a fuel gas supply according to the present invention.

Referring to FIG. 4, the aforesaid connector assembly 20 is installed in a fuel gas cylinder 30. The fuel gas cylinder 30 comprises a guard 31 raised from the top thereof around the connector assembly 20 to protect the connector assembly 20, a pump 36 mounted on the guard 31, a transparent tube 32 connected between the pump 36 and the transverse gas inlet 22 of the connector assembly 20, a plurality of check valves 33 respectively installed in the transparent tube 32 to prevent reverse flow of fuel oil. When in use, the pump 36 is started to pump air through the transparent tube 32 into the air inlet 22, enabling air to flow through the vertical gas input passage hole 223 and an inlet tube 37 to the fuel oil contained inside of the fuel gas cylinder 30, thereby causing a fuel gas to be produced. The fuel gas thus produced immediately flows through the vertical gas output passage hole 213 toward the transverse gas outlet 21. When the rotary fuel gas output control valve 215 is opened, fuel gas immediately flows out of the gas outlet 21 to the gas burner (not shown) via a gas outlet tube 35, which is connected between the gas outlet 21 and the gas burner for burning.

Figure 5:
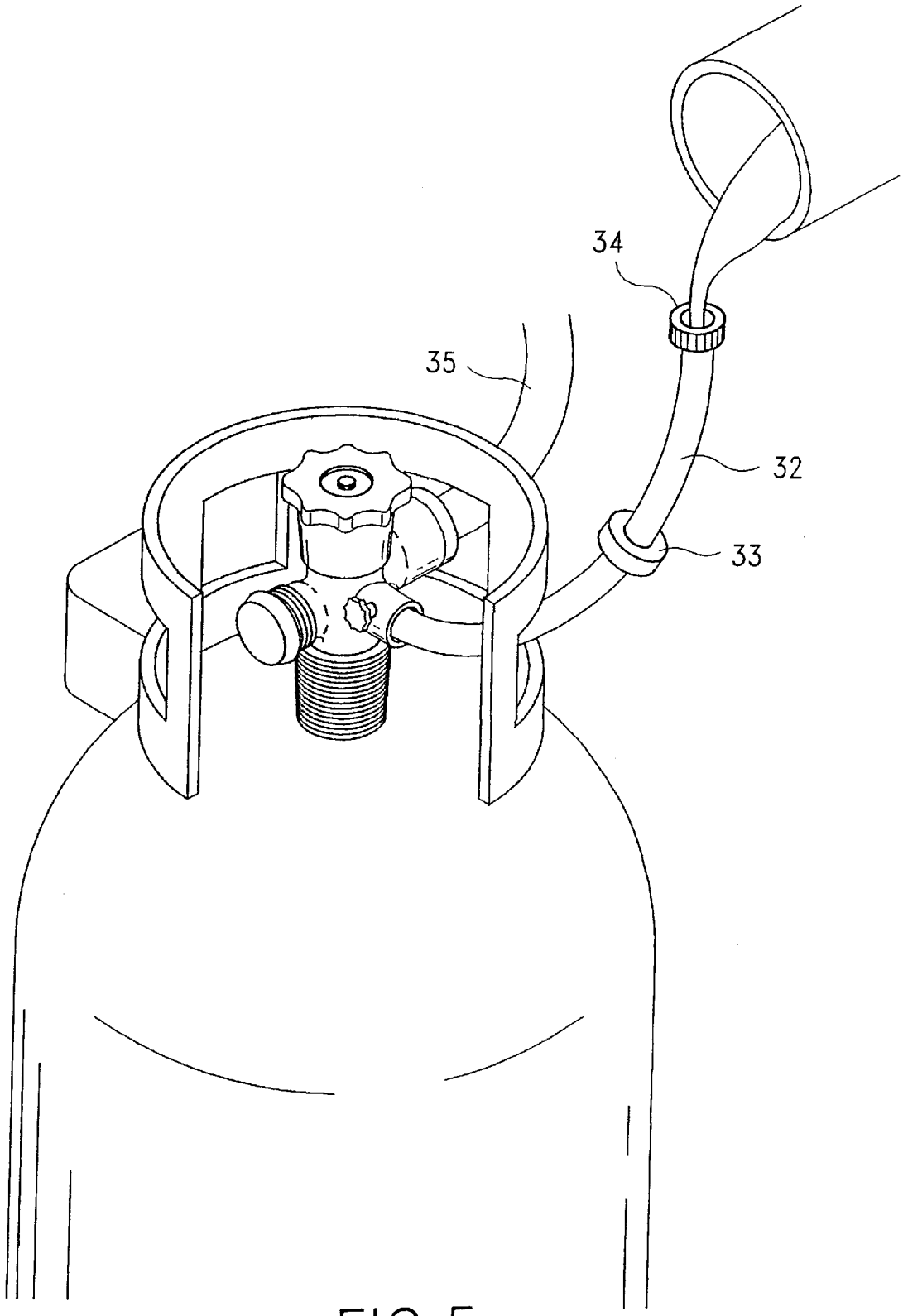
FIG. 5 illustrates the connector at the transparent tube opened, fuel oil filled into the transparent tube at the connector assembly according to the present invention.
Figure 6:
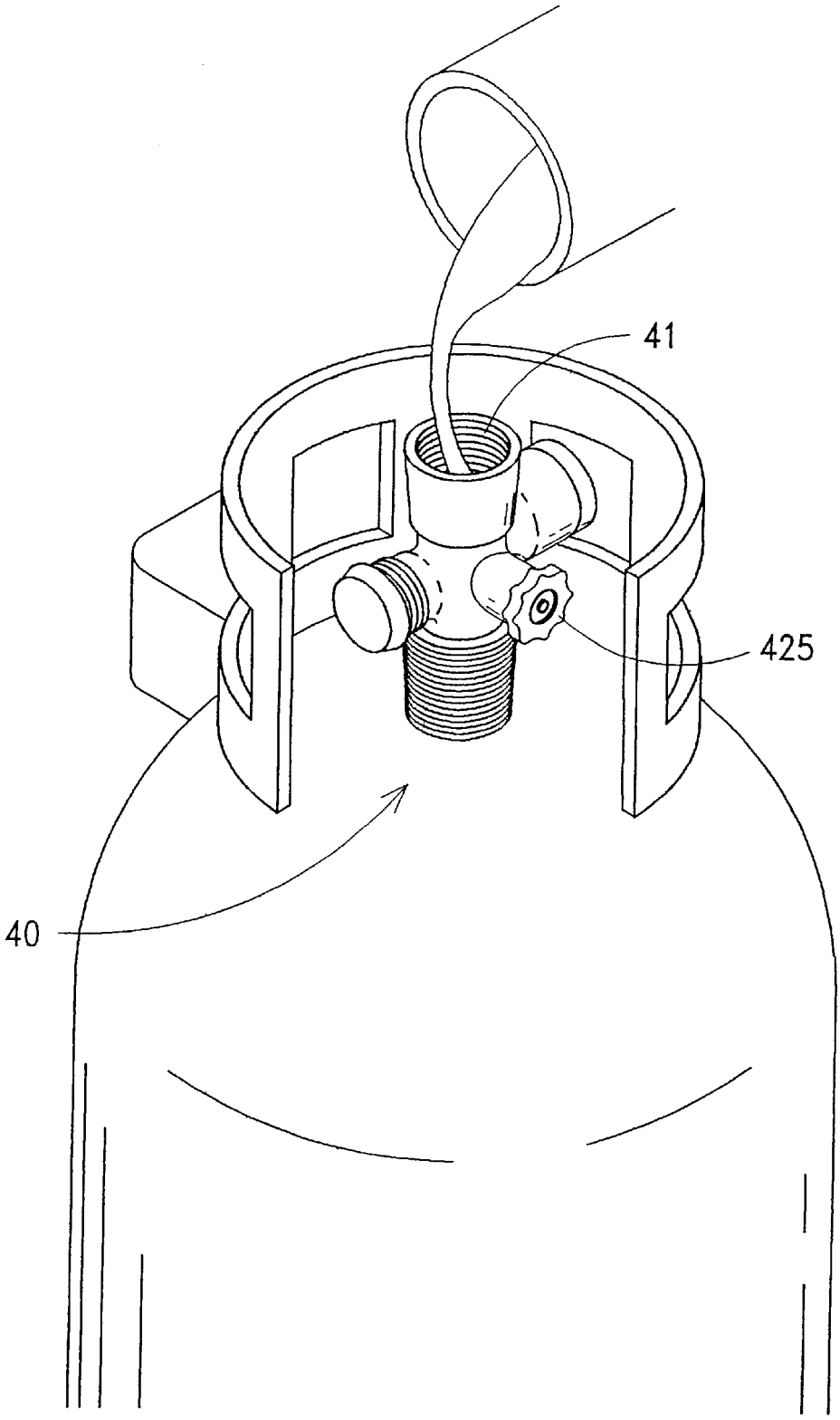
FIG. 6 shows an alternate form of the present invention.

Referring to FIGS. 5 and 6, the transparent tube 32 is comprised of two sections connected together by a connector 34. When the connector 34 is opened, fuel gas can be filled through the connector 34 into the fuel gas cylinder 30 via the gas inlet 22, the vertical gas input passage hole 223 and the inlet tube 37.

FIG. 6 shows an alternate form of the present invention. According to this alternate form, the gas inlet 41 of the connector assembly 40 is vertically disposed at the top, and the rotary fuel gas output control valve 425 is disposed at one side.

It is to be understood that the drawings are designed for purposes of illustration only, and are not intended for use as a definition of the limits and scope of the invention disclosed. For example, a fuel oil filling hole may be provided at the connector assembly for quick filling of fuel oil into the fuel gas cylinder, and a sealing cap is installed in the fuel oil filling hole to close its passage.

What the invention claimed is:

1. A fuel gas supply system for a gas burner comprising:

(a) a fuel gas cylinder defining an inner chamber for storing a liquid fuel, said fuel gas cylinder having a guard formed at a top portion thereof;

(b) a connector assembly coupled to said top portion of said fuel gas cylinder and disposed within said guard, said connector assembly having formed therein:

a gas outlet having a gas output passage hole extending therefrom, said gas output passage hole communicating with said inner chamber of said fuel gas cylinder for guiding the escape of fuel gas therefrom;

a rotary fuel gas output control valve coupled to said gas outlet for selectively controlling the escape of fuel gas through said gas output passage hole;

a gas inlet having a gas input passage hole extending therefrom, said gas input passage hole communicating with said inner chamber of said fuel gas cylinder for guiding the introduction of air into said inner chamber;

a rotary gas input control valve coupled to said gas inlet for selectively controlling the introduction of air through said gas input passage hole;

(c) a pump mounted to said guard of said fuel gas cylinder, said pump being coupled to said gas inlet of said connector assembly for generating a pressurized flow of air, whereby upon introduction into said fuel gas cylinder inner chamber the air mixes with the liquid fuel stored therein to generate fuel gas; and, (d) a transparent tube connected between said pump and said gas inlet, said transparent tube including at least one check valve for preventing the flow of fuel gas from said gas inlet, said transparent tube further including a connector configurable between open and closed states, said connector permitting the introduction of liquid fuel into said fuel gas cylinder inner chamber through said gas inlet.

2. The fuel gas supply system as recited in claim 1 wherein said gas inlet is disposed at a topside of said connector assembly.

3. The fuel gas supply system as recited in claim 1 wherein said transparent tube includes a plurality of said check valves.

* * * * *